United States Patent [19]

DeCou, Jr.

[11] 4,017,757

[45] Apr. 12, 1977

[54] MULTI-TARGET X-RAY TUBE

[75] Inventor: Donald F. DeCou, Jr., West Redding, Conn.

[73] Assignee: The Machlett Laboratories, Incorporated, Stamford, Conn.

[22] Filed: Jan. 2, 1976

[21] Appl. No.: 646,091

[52] U.S. Cl. ..... 313/56; 313/330

[51] Int. Cl.[2] ..... H01J 35/00

[58] Field of Search ..... 313/56, 2

[56] References Cited

UNITED STATES PATENTS

| | | | |
|---|---|---|---|
| 2,836,757 | 5/1958 | Atlee | 313/56 X |
| 2,942,126 | 6/1960 | Silbermann | 313/56 |
| 3,610,984 | 10/1971 | Seki et al. | 313/56 |

*Primary Examiner*—Rudolph V. Rolinec
*Assistant Examiner*—Darwin R. Hostetter
*Attorney, Agent, or Firm*—John T. Meaney; Joseph D. Pannone; Harold A. Murphy

[57] ABSTRACT

An X-ray tube comprising an evacuated envelope having therein a plurality of anode target materials suitably disposed for bombardment by respective electron beams, either simultaneously or alternatively, each of the electron beams being independently variable with respect to one another.

7 Claims, 3 Drawing Figures

MULTI-TARGET X-RAY TUBE

BACKGROUND OF THE INVENTION

1. Field of the Invention

This invention relates generally to X-ray tubes and is concerned, more particularly, with a multi-target X-ray tube suitable for irradiating a variety of materials.

2. Description of the Prior Art

In an X-ray spectroscopy system, the primary source of exciting X-radiation may comprise an X-ray tube of the conventional type which emits a continuous, or "white" band of X-radiation. This bremsstrahlung type of X-radiation may be employed, for example, in irradiating a sample of multi-element material to cause the irradiated elements therein to emit, simultaneously, respective characteristic lines of X-radiation which have associated energy values indicative of the emitting elements. The fluorescent X-rays, thus produced, may be detected by conventional means, such as solid state or proportional counters, for examples, which convert the incident X-rays into respective output pulses. The resulting train of output pulses from the detecting means may be separated electronically, as by a pulse height analyzer, for example, in accordance with the associated energy values of the respective pulses. In this manner, there may be produced for visual display an output energy spectrum wherein the emitting elements in the sample may be identified.

Thus, each element may be identified by its principal characteristic wavelength of fluorescent X-radiation, which is emitted most strongly when the excitation X-rays have a slightly shorter wavelength and a correspondingly higher energy level. Accordingly, when detecting a particular group of elements in a long series of samples, the spectroscopic system may conveniently be provided with X-ray source means for selectively exciting the respective elements of the group to emit most strongly their respective characteristic wavelengths of fluorescent X-radiation. This alternative X-ray source means may comprise an X-ray tube having therein an electron source suitably disposed for directing an electron beam onto a plurality of target materials. Each of the target materials, when bombarded by electrons, produces a highly intense beam of X-rays having desired wavelengths for selectively exciting one of the elements in the group of interest. As a result, the excited elements will emit strong characteristic wavelengths of fluorescent X-radiation which may be more readily detected and displayed, as described.

However, multi-target X-ray tubes generally are provided with a common electron source which is shared by the respective targets. This arrangement necessitates running the long series of samples through the field of X-radiation over and over again until each of the targets, in turn, has been bombarded by the common electron source to produce the respective associated wavelengths of X-radiation. Obviously, this repetitive process is an unnecessarily time consuming and expensive operation. Furthermore, it does not make full use of the sophisticated equipment available for detecting and separating fluorescent X-rays of varying energy values.

Therefore, it is advantageous and desirable to provide an X-ray tube having therein a plurality of target materials which may be bombarded by an electron source, simultaneously or alternatively, as desired.

SUMMARY OF THE INVENTION

Accordingly, this invention provides an X-ray tube comprising a tubular envelope having therein an axially disposed anode provided with an angulated end surface for supporting a plurality of stationary targets at an angle to one another. Each of the targets is radially aligned with a respective arcuate cathode having electrical means for directing an electron beam onto the associated target. The angulated end surface of the anode is disposed adjacent a thin, X-ray transparent window which is maintained at cathode potential and aids in focusing the respective electron beams onto the associated targets. In operation, the cathodes may be energized alternatively or simultaneously to direct respective electron beams onto the associated targets and thereby generate highly intense X-ray beams, each of which is suitable for irradiating particular elements in a sample of material.

BRIEF DESCRIPTION OF THE DRAWINGS

For a better understanding of this invention, reference is made in the following more detailed description to the accompanying drawings wherein.

DESCRIPTION OF THE PREFERRED EMBODIMENT

Figure 1:
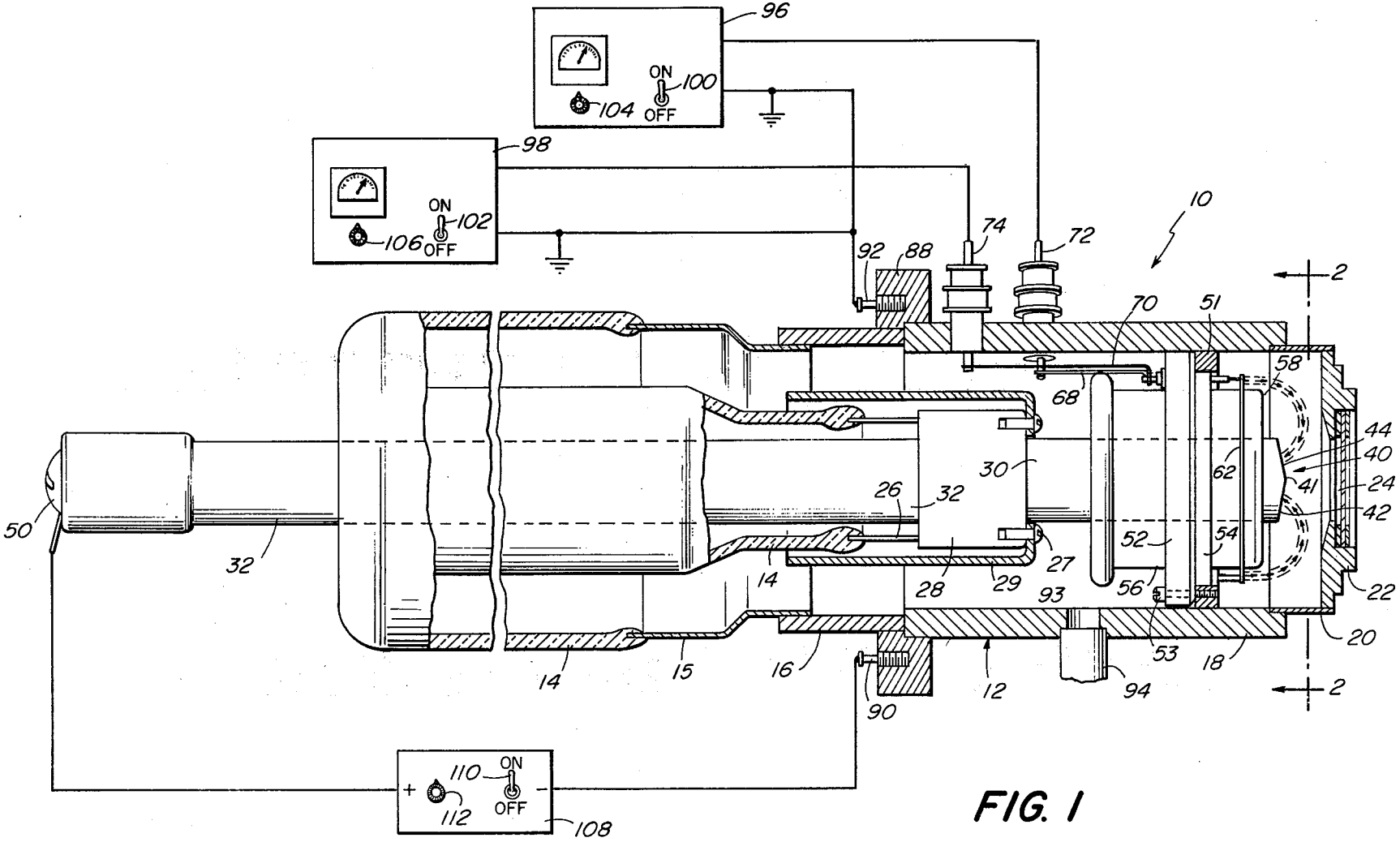
FIG. 1 is an axial sectional view of an X-ray tube embodying the invention.
Figure 2:
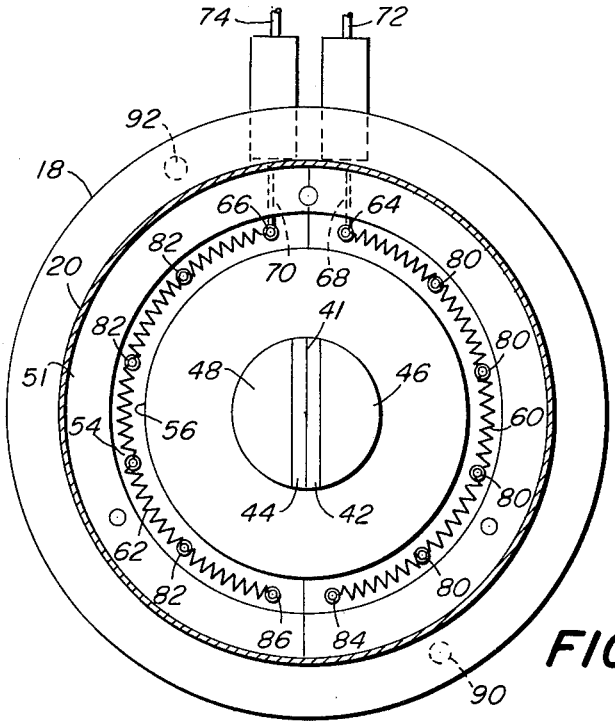
FIG. 2 is a cross-sectional view taken along line 2—2 in FIG. 1 and looking in the direction of the arrows.

Referring to the drawing wherein like characters of reference designate like parts, there is shown in FIGS. 1 and 2 an X-ray tube 10 comprising a tubular envelope 12 having a reentrant end portion 14 made of dielectric material, such as glass, for example. The outer cylindrical rim of reentrant portion 14 is hermetically sealed, in a well-known manner, to one end of a sleeve 15 made of metallic material, such as kovar, for example. The opposing end portion of sleeve 15 is circumferentially sealed to one end of a metallic collar 16, which also may be made of kovar material, for example. The other end of collar 16 is peripherally sealed to one end of a hollow cylinder 18 made of conductive material, such as copper, for example, which is hermetically sealed at the opposing end to a ring 20. Ring 20 is made of conductive material, such as kovar, for example, and is circumferentially sealed to the outer periphery of a bezel 22, which also is made of conductive material, such as nickel, for example. Hermetically sealed over the central opening of the bezel 22 is an X-ray transparent window 24 made of conductive material, such as beryllium, for example, which closes the one end of envelope 12.

The inner cylindrical rim of reentrant portion 14 is peripherally sealed to one end of a metallic collar 26 made of suitable material, such as kovar, for example. The opposing end of collar 26 is circumferentially sealed to one end of a cylindrical anode block 28 made of conductive material, such as copper, for example. The other end of block 28 has secured, as by screws 27, to a peripheral portion thereof an encircling anode shield 29. Opposing ends of the block 28 are attached to respective smaller diameter cylinders 30 and 32 which extend axially of the envelope 12. The cylinder 30 extends axially toward window 24 and terminates in an angulated end surface 40 having a central peak 41 adjacent the window 24. Adjacent the peak 41, end surface 40 may be provided with a pair of diverging sloped areas 42 and 44, respectively. The sloped areas 42 and 44 form predetermined angles, such as 10° respectively, for examples, with a line drawn substantially perpendicular to the longitudinal axis of cylinder 30 and tangential to the peak 41. Supported in a well-known manner by the surfaces 42 and 44 are respective stationary targets 46 and 48 which are made of suitable materials, such as tungsten and chromium, respectively. The cylinder 32 extends out of the reentrant portion 14 and has affixed to the outer end thereof terminal means, such as a screw 50, for example, whereby an electrical conductor may be connected to the described anode structure. The anode block 28 and the respective anode cylinders 30 and 32 may be hollow to provide conduit means for liquid cooling of the anode structure.

Envelope cylinder 18 is provided with an inwardly extending annular flange 51 which has secured thereto, as by screws 53, for example, a first annular cathode deck 52 made of conductive material, such as copper, for example. The deck 52 supports a superimposed second annular deck 54 made of similar conductive material, such as copper, for example, and also supports an inner cylindrical shield 56 made of suitable material, such as nickel, for example. The cathode shield 56 extends in coaxial spaced relationship with the anode cylinder 30, and has a rim 58 at one end which is disposed adjacent the sloped areas 42 and 44 of angulated end surface 40.

Encircling the shield 56 adjacent the rim 58 is a pair of arcuately disposed filaments, 60 and 62, respectively, each of which is radially aligned with a respective one of the targets 46 and 48. Adjacent end portions of the filaments 60 and 62 are electrically connected to respective terminal posts 64 and 66, which extend insulatingly, as by means of dielectric bushings, for example, through the respective cathode decks 52 and 54. On the far side of deck 52, the terminal posts 64 and 66 are electrically connected, as by means of respective conductors 68 and 70, for example, to cathode terminals 72 and 74, respectively. The cathode terminals 72 and 74 extend hermetically and insulatingly through the wall of envelope cylinder 18 to provide means for effecting external electrical connections to the filaments 60 and 62, respectively.

Intermediate portions of the filamentary cathodes 60 and 62 are supported by a plurality of angularly spaced pins 80 and 82, respectively, which are insulatingly supported in the second cathode deck 54. The opposing end portions of filaments 60 and 64, respectively, are electrically connected to respective metal posts 84 and 86 which are attached, as by brazing, for example, to the second deck 54. Thus, the opposing end portions of filaments 60 and 62, are electrically connected, in common, through the respective decks 52 and 54 to the envelope cylinder 18. Cylinder 18 may be provided with an outwardly extending annular flange 88 wherein common cathode terminals, 90 and 92, respectively, may be suitably disposed, as by journaling, for example. Accordlingly, the cathode terminals 90 and 92 provide external means for connecting electrically, in common, to the filaments 60 and 62, respectively.

Envelope cylinder 18 also may be provided with a suitable orifice 93 wherein on end of an exhaust tubulation 94 may be hermetically secured, as by brazing, for example. The exhaust tubulation 94 provides means for evacuating envelope 12 during the processing of tube 10, and is pinched-off by conventional means when processing of the tube is completed.

In operation, the cathode structure of tube 10 may be connected, as by common cathode terminal 92, for example, to respective grounded terminals of filament current sources, 96 and 98, respectively. Other terminals of the sources 96 and 98 may be connected through respective ON-OFF switches 100 and 102 to the cathode terminals 72 and 74, respectively, of tube 10. Thus, by means of the switches 100 and 102, filament current may be passed, either simultaneously or alternatively, through the filaments 60 and 62, respectively. Furthermore, each of the current sources 96 and 98 may be provided with variable control means, such as respective rheostats 104 and 106, for example, for varying the currents flowing through the filaments 60 and 62 independently of one another. Also, the cathode structure of tube 10 may be connected, as by common cathode terminal 90, for example, to a negative terminal of a polarized high voltage source 108. The anode structure of tube 10 may be connected through an ON-OFF switch 110 to the positive terminal of high voltage source 108. Accordingly, by means of switch 110, there may be impressed across the cathode and anode of tube 10 a suitably high voltage, such as 75 kilovolts, for example, for establishing a strong electron accelerating field therebetween. Moreover, the voltage source 108 may be provided with a variable control knob 112 for regulating the strength of the electrostatic field established between the cathode and the anode of tube 10.

It should be noted that the filaments 60 and 62 are arcuately disposed in an annular recess formed by cathode shield 56, second deck 54, and envelope cylinder 18, all of which are maintained at cathode potential. Consequently, electrons emitted from the filaments 60 and 62 egress from the recess and travel toward the window 24. However, window 24 and its supporting structure also are maintained at cathode potential and repel the emitted electrons. On the other hand, the electrons are strongly attracted from the cathode to the anode as a result of the strong electrostatic field established therebetween. Therefore, the electrons follow arcuate paths from the emitting filaments 60 and 62, respectively, to impinge on the respective radially aligned targets 46 and 48. As a result of electrostatic acceleration, the impinging electrons have sufficiently high levels of kinetic energy to generate X-rays which radiate from the respective targets 46 and 48. Accordingly, the X-ray beam egressing through the X-ray transparent window 24 of tube 10 may comprise high energy X-rays emanating from the tungsten target 46 or relatively lower energy X-rays emanating from the chromium target 48 or a composite beam having both types of X-rays therein.

Figure 3:
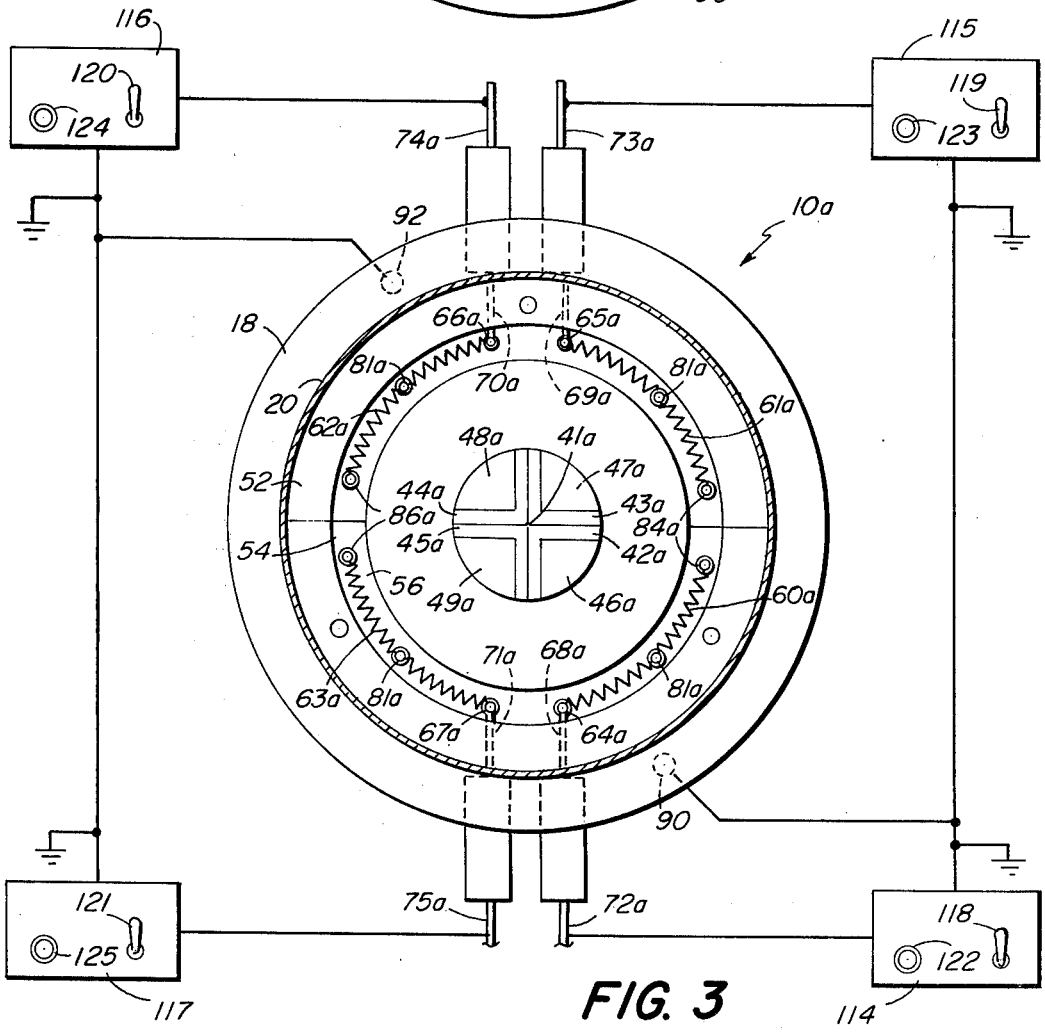
FIG. 3 is a cross-sectional view of an alternative X-ray tube emboying the invention.

FIG. 3 shows an alternative embodiment comprising an X-ray tube **10*a* having a structure similar to the described structure of X-ray tube 10, except for the angulated end surface 40*a* and four filamentary cathodes, 60*a*–63*a*, respectively. The angulated end surface 40*a* has a pyramidal configuration including a central peak 41*a* adjacent the window 24, and four symmetrically sloped areas 42*a*–45*a*, respectively, which converge toward the peak 41*a*. The sloped areas 42*a*, 43*a*, 44*a*, and 45*a* support respective stationary targets 46*a*, 47*a*, 48*a*, and 49*a* in radially aligned relationship with filaments 60***a*, 61*a*, 62*a*, and 63*a*, respectively. The targets 46*a*–49*a* may be made of suitably different materials, such as tungsten, rhodium, chromium, and platinum, respectively, for examples, for exciting characteristic line X-radiation from respective groups of elements in the Periodic Table.

The filaments 60*a*–63*a* are arcuately disposed in the annular recess formed by cathode shield 56, second deck 54, and envelope cylinder 18. Thus, the filaments 60*a*–63*a* encircle the shield 56 and are positioned adjacent the plane of the sloped areas 42*a*–45*a* on angulated end surface 40*a*. Adjacent end portions of the filaments 60*a* and 61*a* are electrically connected to respective metal posts 84*a* which are attached directly, as by brazing, for example, to the second cathode deck 54. Similarly, adjacent end portions of the filaments 62*a* and 63*a* are electrically connected to respective metal posts 86*a* which also are attached directly to the cathode deck 54. Thus, as described for the previous embodiment, the common cathode terminals 90 and 92 provide means for making external electrical connections to respective end portions of the filaments 60*a*–63*a*.

Intermediate portions of the four filaments 60*a*–63*a* may be supported by a plurality of angularly spaced pins, such as 81*a*, for example, which may be insulatingly supported in the second deck 54, as previously described. The opposing end portions of filaments 60*a*–63*a* are electrically connected to respective terminal posts 64*a*, 65*a*, 66*a*, and 67*a* which extend insulatingly through the first and second cathode decks, 52 and 54, respectively. On the far side of deck 52, the terminal posts 64*a*–67*a* are electrically connected through respective conductors 68*a*, 69*a*, 70*a*, and 71*a* to cathode terminals 72*a*, 73*a*, 74*a*, and 75*a*, respectively, which extend hermetically and insulatingly through the wall of envelope cylinder 18. Thus, the respective cathode terminals 72*a*–75*a* provide external means for making electrical connections to the associated end portions of the four filaments 60*a*–63*a*, respectively.

In operation, the anode and cathode structures of X-ray tube 10*a* may be electrically connected to respective positive and negative terminals of polarized high voltage source 108, as previously described. As a result, a suitably high voltage, such as seventy-five kilovolts, for example, may be impressed across the anode and the cathode of tube 10*a* for the purpose of establishing a strong electron accelerating field therebetween. Also, the cathode structure of tube 10*a* may be connected, by means of common cathode terminals 90 and 92, to grounded terminals of four filament current sources 114, 115, 116, and 117, respectively. Other terminals of the sources 114–117 may be connected through respective ON-OFF switches 118, 119, 120, and 121 to the cathode terminals 72*a*, 73*a*, 74*a*, and 75*a*, respectively. Thus, by means of the respective switches 118–121, filament current may be passed, either simultaneously or alternatively, through the filaments 60*a*–63*a*, respectively. Also, each of the current sources 114–117 may be provided with variable control means 122, 123, 124, and 125, respectively, for regulating the currents flowing through the respective filaments 60*a*–63*a*, independently of one another.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described herein is to be interpreted in an illustrative rather than in a restrictive sense.

What is claimed is:

1. A stationary anode X-ray tube comprising:

a tubular envelope having an electrically conductive end portion, said end portion being closed by an X-ray transparent window made of electrically conductive material;

anode means supported within the envelope and including a plurality of stationary targets disposed in axial alignment with the window;

electron emitting means including a plurality of filaments supported within the envelope in radially spaced relationship with the anode means and electrically connected to the window for directing respective electron beams onto the targets, either simultaneously or alternatively; and electrical means connected to the electron emitting means and to anode means for heating the filaments to electron emitting temperatures and for focusing the electron beams onto the respective targets.

2. An X-ray tube as set forth in claim 1 wherein each of the filaments is disposed with respect to the window and a respective one of the targets for directing an electron beam onto the target.

3. An X-ray tube as set forth in claim 1 wherein the targets are made of respective different X-ray generating materials.

4. An X-ray tube as set forth in claim 1 wherein the anode means includes a cylindrical support member having a plurality of sloped surfaces aligned with the X-ray transparent window and with respective filaments of the electron emitting means, each sloped surface supporting a respective target.

5. An X-ray tube as set forth in claim 4 wherein the cylindrical support member has an angulated end surface including a central peak from which the sloped surfaces diverge with respect to one another, the peak being disposed adjacent the X-ray transparent window.

6. An X-ray tube as set forth in claim 5 wherein the filaments are arcuately disposed in an annular array encircling the cylindrical support member and adjacent the sloped surfaces thereof.

7. An X-ray tube as set forth in claim 6 wherein the electrical means includes current source means for heating the filaments to electron emitting temperatures, either simultaneously or alternately.

* * * * *